United States Patent [19]

Seanor et al.

[11] 4,014,606

[45] Mar. 29, 1977

[54] REPRODUCTION MACHINE WITH TEXTURED TRANSFER ROLLER

[75] Inventors: Donald A. Seanor, Pittsford; James A. Lentz, Penfield; Thomas Meagher, West Webster, all of N.Y.

[73] Assignee: Xerox Corporation, Stamford, Conn.

[22] Filed: Aug. 13, 1975

[21] Appl. No.: 604,514

Related U.S. Application Data

[63] Continuation of Ser. No. 410,063, Oct. 24, 1973, abandoned.

[52] U.S. Cl. ..... 355/3 R; 96/1.4

[51] Int. Cl.[2] ..... G03G 15/16

[58] Field of Search ..... 355/3 R, 3 TR, 3 DD, 355/16, 17; 96/1.4; 101/DIG. 13; 118/637

[56] References Cited

UNITED STATES PATENTS

| | | | |
|---|---|---|---|
| 3,633,543 | 1/1972 | Pitasi et al. | 355/3 TR X |
| 3,795,441 | 3/1974 | Hoffman et al. | 355/3 TR |

*Primary Examiner*—L. T. Hix
*Assistant Examiner*—Kenneth C. Hutchison
*Attorney, Agent, or Firm*—Earl T. Reichert

[57] ABSTRACT

An electrostatic reproduction machine has a photoconductive member and a transfer roller in contact therewith, the roller having a texturized surface formed so as to prevent or minimize the possibility of a sheet of paper wrapping itself around the roller as the sheet is passing between the photoconductive member and the roller during the transfer operation.

1 Claim, 4 Drawing Figures

REPRODUCTION MACHINE WITH TEXTURED TRANSFER ROLLER

This is a continuation of application Ser. No. 410,063, filed Oct. 24, 1973, now abandoned.

BACKGROUND OF THE INVENTION

This invention relates to an electrostatographic machine, but more particularly to such a machine having a novel transfer roller.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to thereby discharge the charge in the areas where light strikes the layer. The undischarged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is the greatest, the greatest amount of material is deposited; and where the field is the least, little or no material is deposited. Thus, a powder image is produced in conformity with the light image of the copy being reproduced. The powder image is subsequently transferred to a sheet of paper or other surface and suitably affixed thereto to form a permanent print. The powder image may be affixed by passing the sheet of paper or other surface having the transferred image between a heated roller and a second roller in pressure contact therewith, whereby the powder image becomes fused to the sheet of paper.

The powder image is sometimes transferred to an image receiving member by passing the member between the photoconductive surface including the developed image and a biased transfer roller in contact therewith. One of the problems sometimes encountered in using a biased transfer roller is that the paper tends to wrap itself around the roller during the transfer step or operation. Thus, what is needed is a transfer roller which will eliminate or minimize this paper wrapping problem.

SUMMARY OF THE INVENTION

The present invention is directed to a novel transfer roller which eliminates or minimizes the above paper wrapping problem; the peripheral surface of this novel roller is texturized in one of several ways. For example, the texturizing may be accomplished by covering the roller with a textured material such as that used for nylon stockings, by grinding the roller surface, by molding the roller in a mold, by embossing the desired surface on the roller, by winding monofilament around the roller, or by applying a sponge-like overcoat to the roller.

BRIEF DESCRIPTION OF THE DRAWINGS

A better understanding of the present invention as well as other objects and further features thereof will become apparent upon consideration of the following detailed disclosure thereof, especially when taken with the accompanying drawings, wherein like numerals designate like parts throughout.

FIGS. 2, 3, and 4 are partial enlarged views of the transfer roller of the invention.

DETAILED DESCRIPTION OF THE INVENTION

Figure 1:
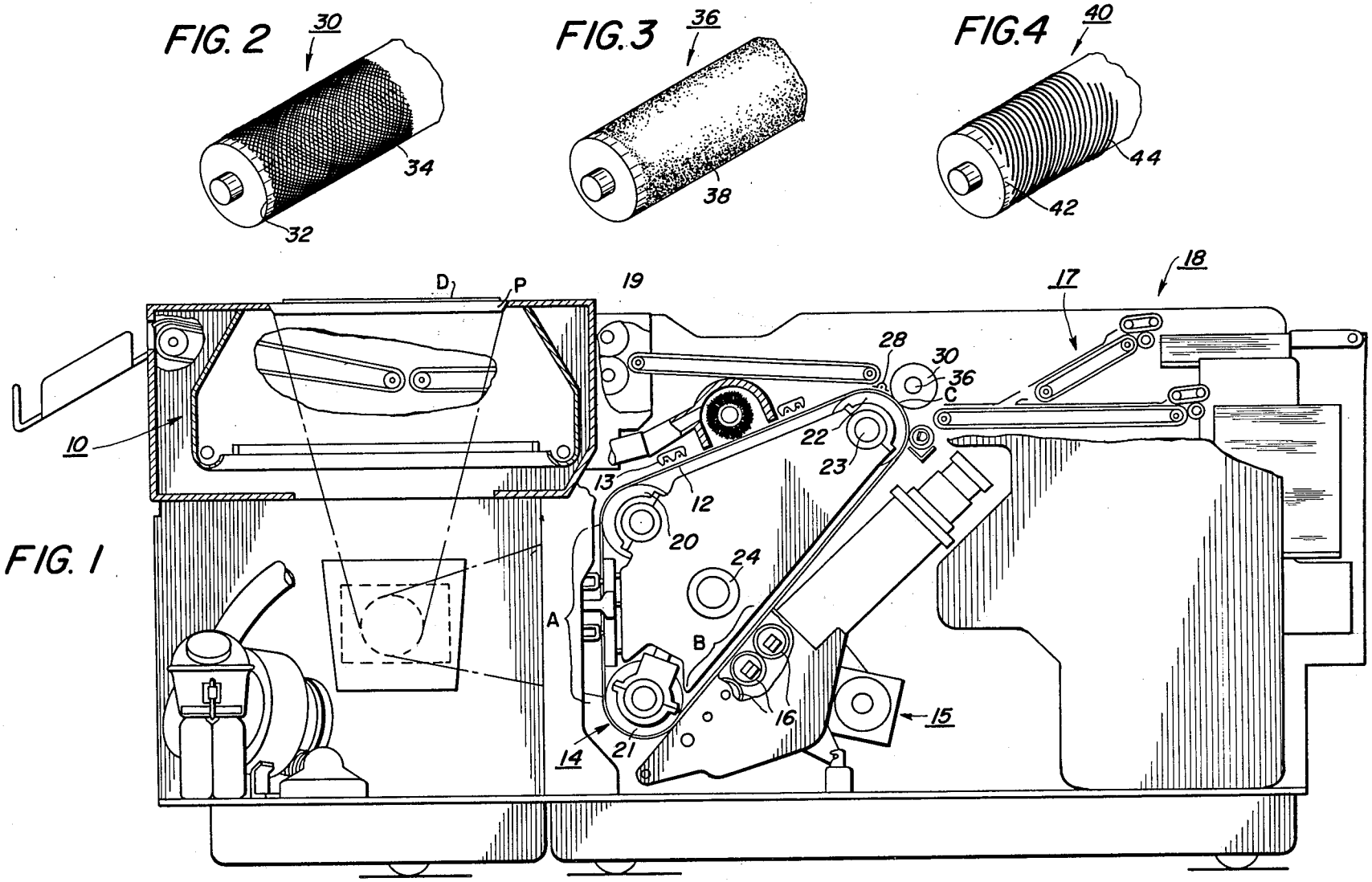
FIG. 1 is a schematic sectional view of an electrostatic reproduction machine embodying the principles of the invention.

For a general understanding of the illustrated copier/reproduction machine in which the invention may be incorporated, reference is had to FIG. 1 in which the various system components for the machine are schematically illustrated.

A document D to be copied is placed upon a transparent support platen P fixedly arranged in an illumination assembly, generally indicated by the reference numeral 10, positioned at the left end of the machine. Light rays from the illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same by means of a corona generating device 13.

The belt is journaled for continuous movement upon three rollers 20, 21, and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During such movement of the belt 12, the reflected light image of such original document positioned on the platen is flashed on the surface of the belt to produce an electrostatic latent image thereon at exposure station A.

As the belt surface continues its movement, the electrostatic image passes through a developing station B in which there is positioned a developer assembly generally indicated by the reference numeral 15, and which provides development of the electrostatic image by means of multiple brushes 16 as the same moves through the development zone.

The developed electrostatic image is transported by the belt to a transfer station C where the present invention is positioned, and where a sheet of copy paper is moved between a transfer roller and the belt at a speed in synchronism with the moving belt in order to accomplish transfer of the developed image solely by an electrical bias on the transfer roller. There is provided at this station a sheet transport mechanism generally indicated at 17 adapted to transport sheets of paper from a paper handling mechanism generally indicated by the reference numeral 18 to the developed image on the belt at the station C.

After the sheet is stripped from the belt 12, it is conveyed into a fuser assembly, generally indicated by the reference numeral 19, wherein the developed and transferred xerographic powder image on the sheet material is permanently affixed thereto. After fusing, the finished copy is discharged from the apparatus at a suitable point for collection externally of the apparatus.

Further details regarding the structure of the belt assembly 14 and its relationship with the machine and support therefor may be found in the copending application Ser. No. 102,312, now U. S. Pat. No. 3,730,623 assigned to the same assignee. Referring to FIG. 2, there is illustrated a transfer roller generally indicated as 30 having a texturized surface formed by covering a roller per se 32 with a textured material 34, e.g., nylon as used for nylon stockings.

FIG. 3 shows a texturized roller 36 formed by grinding the surface of a conventional transfer roller with a grinding wheel to develop a texturized surface 38. The peak to valley dimension of the surface which is ground is preferably in the range of 2 to 8 mils, and the frequency of the peaks is preferably about 40 peaks per linear inch or greater, but may be as low as 20 to 30 peaks per linear inch depending upon the criteria regarding print-out. This latter phrase refers to the impression of the texturized surface on the sheet of paper or other surface to which the powder image is being transferred.

FIG. 4 shows a conventional transfer roller 40 on which a texturized surface is formed by winding a strand of nylon monofilament 42 around the roller at an angle to the rotational axis of the roller to produce a continuous annular groove 44 around the surface.

As stated above various other means may also be used to produce a texturized surface on a transfer roller. A texturized surface can also be formed by coating a transfer roller with a thermal setting resin that has some tack time before curing, and then sprayed with particulate material such as various carbon black filled materials or polyvinylchloride. The particulate coating is then contacted by a doctor blade while the roller is rotating so that a uniform thickness is deposited around the roller.

A texturized surface may also be formed by embossing the surface of the roller. This is effected by coating a conventional transfer roller with a clear resin, and when the resin reaches a pseudo-plastic state, rolling the roller over a heated screen to form a pattern on the surface of the roller.

The theory of operation of the above roller is believed to be the following: Breakdown (ionization) of the air occurs between the transfer roller and the photoreceptor. If a sheet of paper passing between the roller and the photoreceptor is closer to the photoreceptor as it exits the nip, it will be positively charged and tack itself to the photoreceptor, and will later be detacked to pass along its normal paper path. If the paper is closer to the transfer roller, it will be negatively charged and tack itself to the transfer roller. To prevent or minimize the possibility of the latter happening, the surface of the transfer roller is texturized. This results in having the air breakdown occur in the valleys of the texturized surface while the peaks of the surface hold the paper away from the transfer roller and allow it to tack itself to the photoreceptor.

While the invention has been described with reference to the structure disclosed, it is not confined to the details set forth but is intended to cover such modifications or changes as may come within the scope of the following claim.

What is claimed is:

1. A reproduction machine comprising:

means defining a surface, the surface being mounted for movement around a closed path;

means for forming a developed electrostatic image on the surface;

a transfer roller in contact with the surface and mounted for rotation about an axis;

means for feeding a sheet of support material between the surface and the transfer roller so that transfer of the developed electrostatic image from the surface to the sheet can be effected as the sheet is moving therebetween; and means formed on the peripheral surface of the transfer roller for preventing the sheet from electrostatically tacking itself to the transfer roller during transfer while simultaneously causing the sheet to electrostatically tack itself to the surface.

* * * * *